US005626266A

United States Patent [19]

Michelson

[11] Patent Number: 5,626,266

[45] Date of Patent: May 6, 1997

[54] CONTAINER CONTENT REMOVAL DEVICE

[76] Inventor: Gary K. Michelson, 438 Sherman Canal, Venice, Calif. 90291

[21] Appl. No.: 391,255

[22] Filed: Feb. 17, 1995

Related U.S. Application Data

[63] Continuation of Ser. No. 97,153, Jul. 26, 1993, abandoned.

[51] Int. Cl.[6] ..... B67D 5/42

[52] U.S. Cl. ..... 222/386; 215/231; 220/578; 222/405; 426/115; 426/124

[58] Field of Search ..... 222/386, 405; 220/578, 580; 215/231; 426/115, 124

[56] References Cited

U.S. PATENT DOCUMENTS

| | | | |
|---|---|---|---|
| 522,693 | 7/1894 | McLaughlin | 222/386 X |
| 1,468,152 | 9/1923 | Hemstreet | 222/386 X |
| 3,053,410 | 9/1962 | Eaddy | 222/405 |
| 4,471,892 | 9/1984 | Coleman | 220/578 X |
| 4,684,042 | 8/1987 | Strickler et al. | 220/578 X |
| 4,832,968 | 5/1989 | Forage et al. | 426/124 X |

FOREIGN PATENT DOCUMENTS

| | | | |
|---|---|---|---|
| 438239 | 11/1935 | United Kingdom | 220/578 |
| 538762 | 6/1950 | United Kingdom | 215/231 |

*Primary Examiner*—Andres Kashnikow
*Assistant Examiner*—Joseph A. Kaufman

[57] ABSTRACT

A container assembly includes a central connecting member that extends to an attached support plate at the bottom of the container. After opening the top of the container, lifting of the connecting member results in the contents of the container being pulled up by the support plate for ease of use. The use of the assembly is particularly useful for materials having a thick consistency such as dog food or cat food or spackling paste which are difficult to remove from their containers. In the preferred embodiment the support plate includes openings to drain any liquid from the contents of the container as the contents are being lifted from the container.

28 Claims, 6 Drawing Sheets

CONTAINER CONTENT REMOVAL DEVICE

This is a continuation of application Ser. No. 08/097,153, filed on Jul. 26, 1993 now abandoned.

BACKGROUND

1. Field of the Invention

This invention relates to container assemblies and in particular to an improved container assembly with means for easily removing the contents of a container.

2. Description of the Related Art

It has long been a recognized problem that foods having a thick consistency such as canned meats, including dog or cat foods, or even tomato paste, are difficult to remove from a container. Once the container is opened it is necessary to use a spoon or other utensil to scoop out the food from the container. Alternatively, it is necessary to use a knife to cut around the sides of the food to break the seal and cohesiveness between the food and the sides of the container. Other methods of removing the food from the container consist of opening both the top and the bottom ends of the container and then pushing the bottom lid through the container in order to push out the entire contents of the container. Similar problems have also been recognized in containers for non-food items such as putty or spackling paste.

It is also recognized that it is common to use only a portion of the contents of a food container. Therefore, it is undesirable to destroy the container in the process of removing a portion of the contents, such as opening both ends of the container.

SUMMARY OF INVENTION

A container constructed with a connecting member that attaches to a support plate at the bottom of the container and extends substantially to the top of the container. The contents of the container, such as dog or cat food or any other material having a similar consistency, surrounds the connecting member and covers the support plate. The connecting member is attached at its other end to a finger engaging handle which protrudes from the top surface of the contents of the container. The container is then sealed in the conventional manner. When it is desired to remove the contents of the container, the top cover of the container is removed in the conventional manner and the connecting member that extends above the top surface of the contents of the container is lifted, thereby lifting the lower support plate and the contents of the container contained above the lower support plate. The amount of the contents of the container desired to be removed is cut or scooped off into a separate container, such as a dish.

In the preferred embodiment of the present invention the connecting member is flexible, such as a string, wire or a hollow flexible tube, so that it may be rested on the top of the remaining portion of the contents of the container when only a portion of the contents of the container is removed. The container would then be covered by a typical well-known cover, such as a plastic lid, and stored for future use. When it is desired to remove additional contents of the container at a later date the flexible connecting member would be grasped and pulled up again to lift out the contents remaining in the container.

OBJECTS OF THE INVENTION

It is an object of the present invention to provide an improved container construction that is easy to use;

It is another object of the present invention to provide an improved container construction with a content removal assembly that is easy to assemble;

It is yet another object of the present invention to provide an improved container construction with a content removal assembly that is inexpensive to manufacture;

It is yet another object of the present invention to provide an improved container construction with a content removal assembly that is reliable; and It is a further object of the present invention to provide a container construction with a content removal assembly that avoids waste at the bottom of a container.

These and other objects of the present invention will be apparent from a review of the detailed description of the drawings and the accompanying drawings.

DETAILED DESCRIPTION OF THE DRAWINGS

Figure 1:
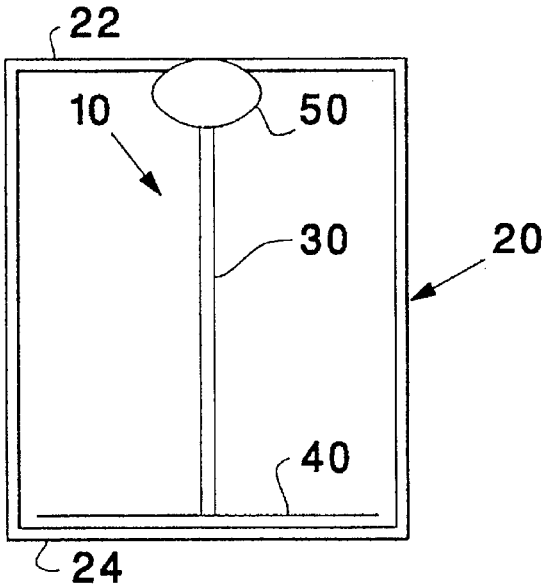
FIG. 1 is a side view of a cylindrical container containing the content removal assembly of the preferred embodiment.

Referring to FIGS. 1–10 the content removal assembly is referred to generally as 10. A container 20, such as a dog food container, is constructed so that a connecting member 30 attaches to a lower support plate 40 at the bottom 24 of the container 20 and extends substantially to the top 22 of the container 20. Connecting member 30 of a flexible material such as plastic, rubber or metal. The connecting member container may be a wire, a string or thread, a hollow flexible tube or even a solid post. One end of connecting member 30 is connected to the support plate 40 and the other end of connecting member 30 is secured to a finger engaging handle 50. The finger engaging handle 50 may be made of the same material as the connecting member 30 or may also be made of any other non-toxic or non-corrosive material such as metal suitable for canned foods or plastic.

Figure 2:
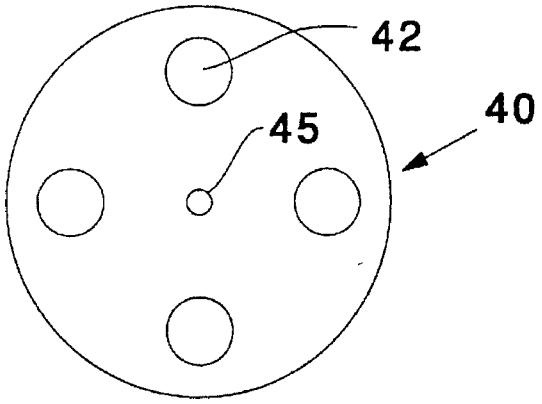
FIG. 2 is a bottom end view of the support plate of the content removal assembly of the present invention.

The lower support plate 40 is made of a rigid material capable of supporting the contents of the container when the finger engaging handle 50 is pulled. The support plate 40 may be shaped to conform to the shape of the container in which it is used. As shown in FIG. 2, the support plate 40 for use in a cylindrical container 20 is circular and conforms to the shape of the container 20. The diameter of the support plate 40 is slightly smaller than the diameter of the container 20 so that it may easily slide and fit inside the container 20. The support plate 40 also has openings 42 so that any liquid from the contents of the container 20 may be drained as the support plate 40 is lifted from the container 20. The openings 42 may be circular openings as shown in FIG. 2 or may be in any other shape such as elongated slots. In a slot configuration, the openings 42 are suitably sized so as not to permit the contents of the container to slip therethrough.

Figure 6:
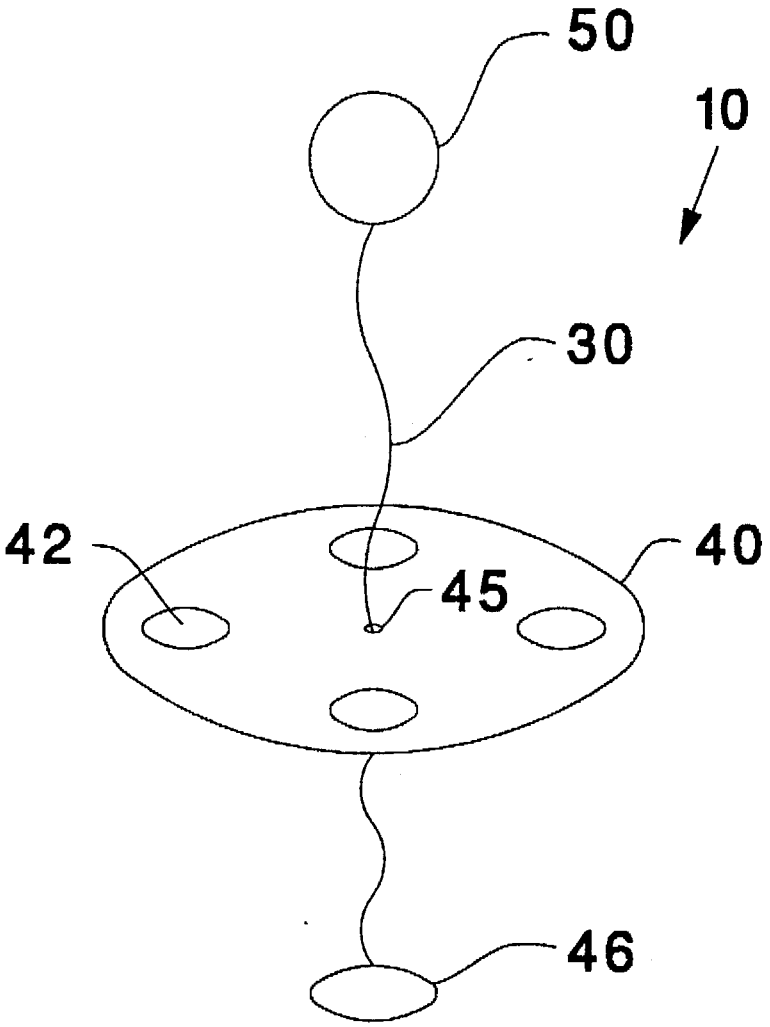
FIG. 6 is a perspective view of the content removal assembly of the present invention showing a means for connecting the connecting member to the support plate.

The support plate 40 also has a central aperture 45 through which the connecting member 30 may be threaded and then attached to a stopper 46 having a larger diameter than the central aperture 45 as shown in FIG. 6. The stopper 46 is positioned at the bottom of the support plate 40 and acts as a means for engaging the support plate when the connecting member 30 is lifted.

Figure 3:
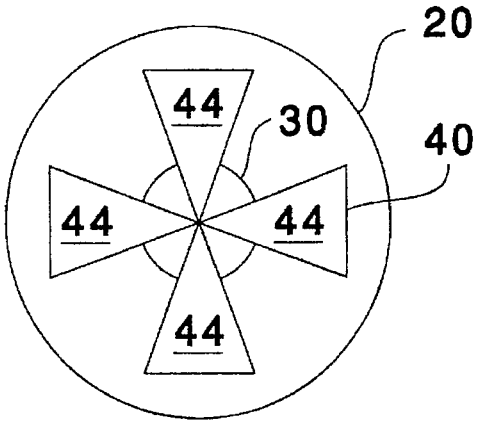
FIG. 3 is a bottom end view of an alternative embodiment of the support plate of the content removal assembly container of the present invention.

In an alternative embodiment of the present invention, instead of being circular, the lower support plate 40 comprises of a number of fan-like side extensions 44 as shown in FIG. 3. The fan-like side extensions 44 would be used when the contents of the container 20 have a thick consistency such as canned meats. As canned meats tend to stick together and retain the shape of the interior of the container 20, it is not necessary to have a circular support plate 40 as shown in FIG. 2. A support plate 40 as shown in FIG. 3 would be adequate to lift the canned meats out from the container 20.

Figure 4:
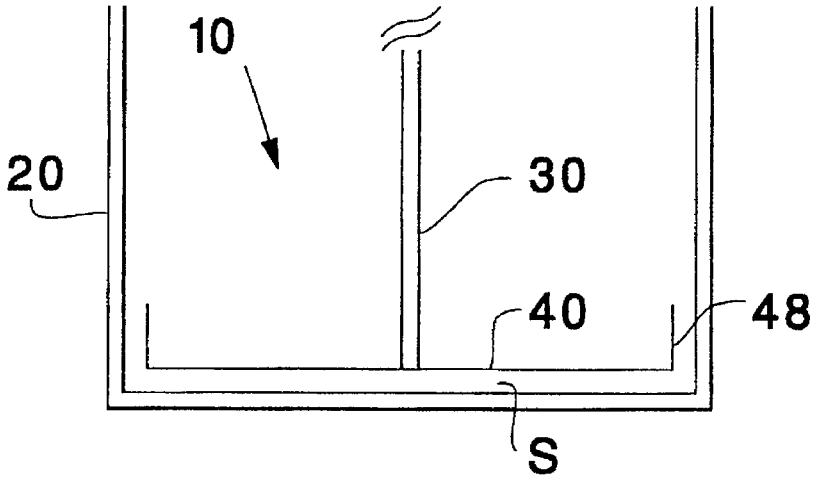
FIG. 4 is a side view of a container containing an alternative embodiment of a content removal assembly which has a raised lip at its circumference.
Figure 5:
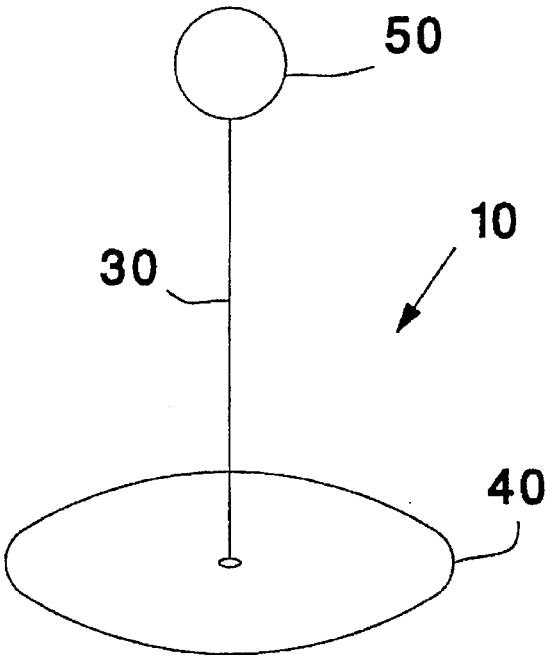
FIG. 5 is a perspective view of the content removal assembly of the present invention.

As shown in FIG. 4, the support plate 40 may also have an upstanding lip 48 at its circumference to scrape the sides on the inside of container 20 as the support plate 40 is lifted from the container 20 in order to avoid leaving any contents of the container 20 on the bottom or on the sides of the container 20.

Figure 7:
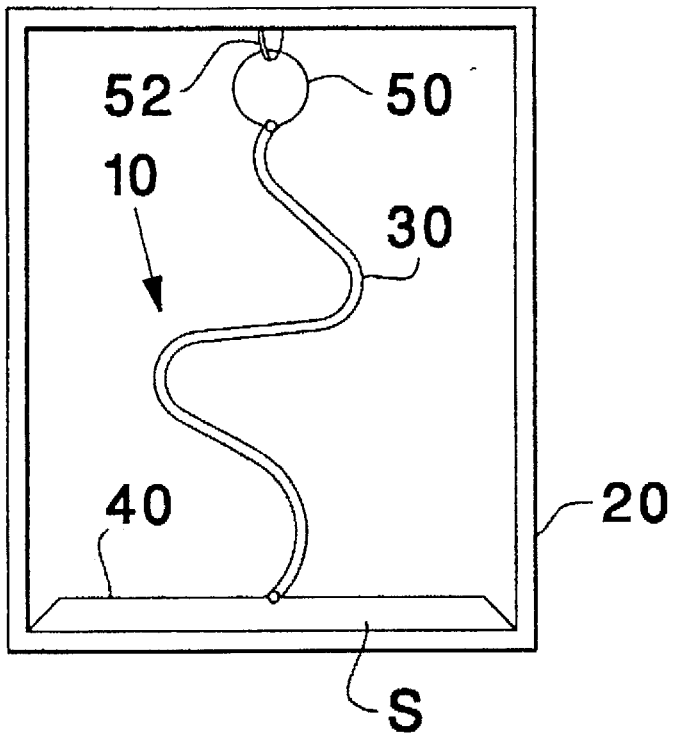
FIG. 7 is a side view of a cylindrical container containing the content removal assembly of the present invention attached to the top cover of the container.

As shown in FIG. 7, as an alternative embodiment of the present invention, the connecting member 30 may be a hollow flexible tube and may have a length that is substantially longer than the distance between the support plate 40 and the top 22 of the container 20 so the connection between the finger engaging handle 50 and the support plate 40 is slack as shown in FIG. 7. As the finger engaging handle 50 is lifted, the connecting member 30 is pulled taut to remove the slack in the connecting member. As the slack is removed, the connecting member 30 being, a hollow flexible tube, creates an air channel throughout the contents of the container 20. The air channel permits air from the exterior of the container 20 to flow through the connecting member 20 and to communicate with the space S below the support plate 40 through the central aperture 45. In the space S, between the bottom of the contents within the container and the bottom 24 of the container 20, a vacuum exists which acts to pull and keep the contents of the container from being removed from the container 20. The vacuum in the container is eliminated by the communication of air through the connecting member 30 to the space S. As a result, the contents of the container 20 may be easily removed by lifting the support plate 40. Once the contents of the container 20 are lifted by the support plate 40, the amount of the contents desired to be removed is cut or scooped off into a separate container, such as an animal's food dish.

As an alternative, an air channel may be created through the contents of container 20 by a connecting member 30 that is a string or a wire instead of a hollow tube. When the string or wire of the connecting member 30 is lifted, an air channel is created in the contents of the container 20 so that air flows from the exterior of the container, through the air channel and through the central aperture 45 of the support plate 40 to eliminate the vacuum between the contents of the container and the bottom 24 of the container 20.

As it is possible that the finger engaging handle 50 might sink into the top surface of the contents of the container during shipping or inversion of the container, the finger engaging handle 50 may be removably affixed by a ring 52 to the inside of the top 22 of the container 20 as shown in FIG. 7. When the top 22 of the container 20 is removed, it lifts the finger engaging handle 50 out of the contents of the container 20. The user may then remove the finger engaging handle 50 from the ring 52 and commence pulling on the finger engaging handle 50 or the user may continue to lift the top 22 in order to raise the supporting plate 40 and the food supported thereon out of the container 20.

Figure 8:
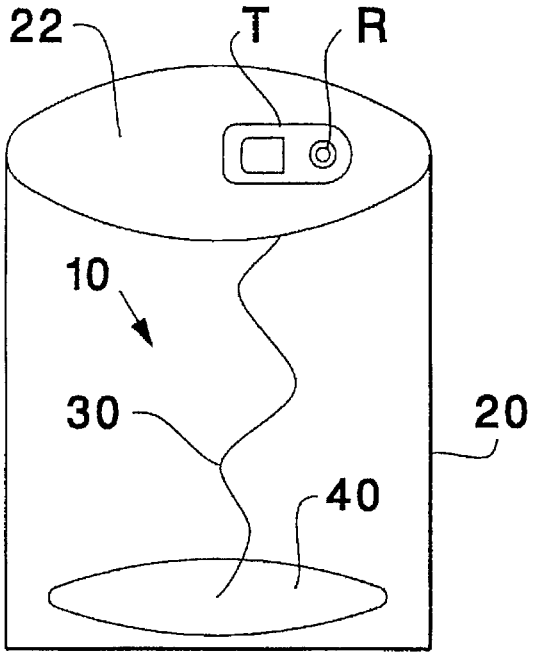
FIG. 8 is a top view of a container having a pop-top removable lid with an opening tab riveted to the lid.
Figure 9:
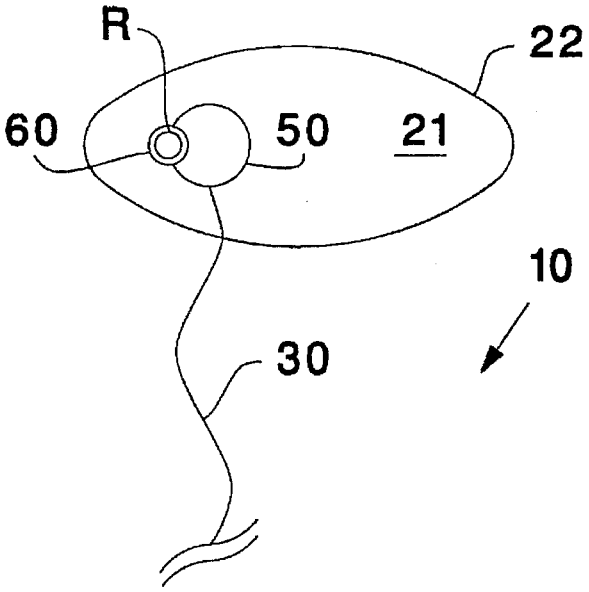
FIG. 9 is a bottom view of the lid in FIG. 8 with the finger engaging handle connected to the bottom of the rivet in the lid.
Figure 10:
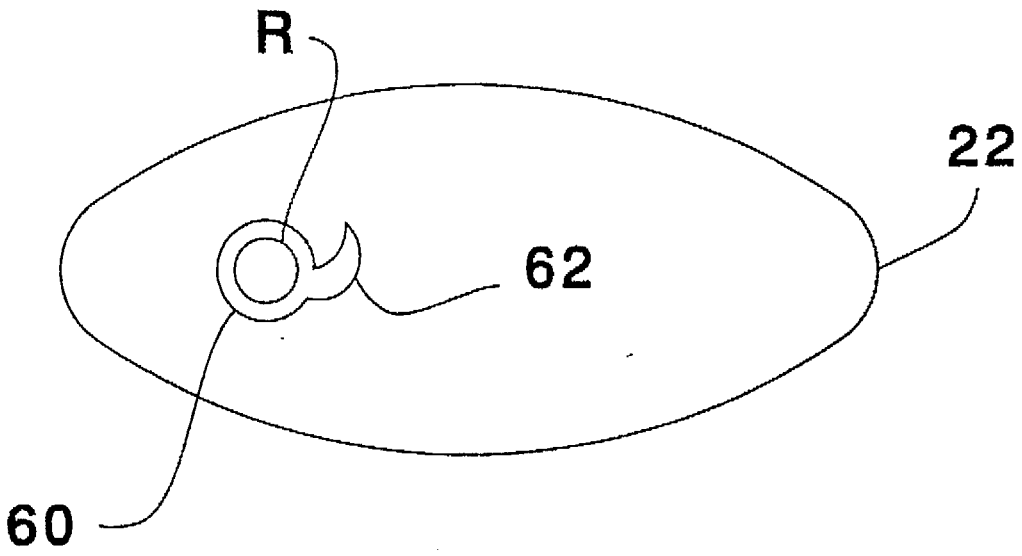
FIG. 10 is a bottom view of the lid in FIG. 8 with the bottom of the rivet having a hook extension for engaging the finger engaging handle.

Referring to FIGS. 8–10, in containers having a "pop top" removable top 22, an external tab T used to pry open the top 22 and then to pull the top 22 back is typically riveted to the top 22. A portion 60 of the rivet R which passes through the top 22 and fastens to the interior surface 21 of the top 22 may be attached to the finger engaging handle 50 so that when the top 22 is pulled back, the connecting member 30 is also pulled. Once the top 22 is separated from the container, the contents of the container may be lifted out.

As shown in FIG. 10, as an alternative, the portion 60 of the rivet R may have a hook member 62, extending from the interior surface 21, for engaging the finger engaging handle 50 once the top 22 of the pop-top container is removed. The hook member 62 avoids the need for the user of the container 20 to use his fingers to engage the finger engaging handle 50.

During assembly, the container assembly 10 of the present invention is inserted in the container 20 at the time the container 20 is filled with the contents to be stored therein. The support plate 40 with the flexible connecting member 30 already attached is inserted so that it is seated at the bottom of the container 20. The contents of the container 20, such as dog or cat food, tomato paste, or other non-food material are then poured into the container 20 and surround the connecting member 30 and cover the surface 32 of support plate 40. If the connecting member 30 is a hollow flexible tube as shown in FIG. 7, it is placed within the contents of the container so that it is not fully extended in order to maintain a slack between the finger engaging handle 50 and the support plate 40. The finger engaging handle 50 is then placed so that it protrudes from the top surface of the contents of the container or may be attached to the top 22 as described above. The container 20 is then sealed in the conventional manner.

When it is desired to remove the contents of the container 20, the top cover 22 is removed in the conventional manner and the connecting member 30 that extends above the top layer of the contents of the container is lifted either manually or by the top 22 if attached thereto, thereby lifting the support plate 30 the contents of the container 20 contained above the lower support plate 40.

While the present invention has been described in detail with respect to its preferred embodiment, it is appreciated that other variations of the present invention may be devised which do not depart from the inventive concept of the present invention.

For example, the container 20 instead of being cylindrical may be in the shape of an oval, rectangle, or a square. The food assembly 10 of the present invention would then be shaped to correspond to the shape of the container 20. The food container 20 may also be made of a plastic material, coated paper or any other suitable material.

What I claim is:

1. A container comprising an enclosed member having a side wall having top and bottom edges, and top and bottom covers, said top and bottom covers having an inside surface and an outside surface, said top and bottom cover being formed integrally with the top and bottom edges of said side wall, said top and bottom covers being of substantially the same size, a lower internal rigid support plate for supporting contents within said container, said support plate being movable in relationship to said top and bottom covers, a connecting member attached at its lower end to said support plate, the upper end of said connecting member extending from said support plate substantially to said top cover.

2. The container of claim 1 in which said connecting member is flexible.

3. The container of claim 2 in which said connecting member is a wire.

4. The container of claim 1 in which said connecting member is a post.

5. The container of claim 1 in which said connecting member is a hollow tube.

6. The container of claim 1 in which said support plate consists of a thin flat plate.

7. The container of claim 6 in which said support plate has openings to let liquid drain through said openings to the bottom of the container.

8. The container of claim 1 including a finger engaging means at the top of said connecting member.

9. The container of claim 8 in which said finger engaging means is secured to the top cover of said container.

10. The container of claim 9 including means for securing said connecting member to said support plate.

11. The container of claim 8 including means for removably engaging said finger engaging means.

12. The container of claim 11 in which said means for removably engaging said finger engaging means is attached to said top cover of said container.

13. The container of claim 1 in which said support plate includes at least one side extension on said support plate.

14. The container of claim 1 in which said member is cylindrical.

15. The container of claim 1 in which said support plate has an aperture through which said connecting member passes.

16. The container of claim 15 in which said connecting member is flexible and placed within the contents of the container in a loosely folded manner.

17. The container of claim 16 in which said connecting member is a hollow tube.

18. The container of claim 17 in which said connecting member forms a channel for communicating air through the contents of the container so that when said connecting member is lifted out of the container air flows from the exterior of the container through said connecting member and through said aperture of said support plate to break a vacuum seal that normally exists between the bottom cover of the container and the contents of the container.

19. The container of claim 16 in which said connecting member forms an air channel for communicating air through the contents of the container so that when said connecting member is lifted out of the container air flows from the exterior of the container through the air channel and through said aperture of said support plate to break a vacuum seal that normally exists between the bottom cover of the container and the contents of the container.

20. The container of claim 1 wherein said connecting member is attached at its upper end to the inside surface of said top cover.

21. The container of claim 20 in which said upper end of said connecting member is removably attached to the inside surface of said top cover.

22. The container of claim 1 in which said connecting member is a flexible member.

23. A container comprising a member forming a side wall having top and bottom edges, top and bottom covers formed integrally with the top and bottom edges of said side wall, a lower internal support plate, said support plate being movable in relationship to said top and bottom covers, and a connecting member attached to said support plate, said connecting member extending from said support plate substantially to said top cover, said connecting member having a pair of side extensions connecting to a point that is along the diameter of said support plate.

24. A container having a content removal assembly comprising a member forming a side wall having top and bottom edges, top and bottom covers formed integrally with the top and bottom edges of said side wall, means for creating a channel for communicating air through the contents of the container so that air flows from the exterior of the container through said channel to break a vacuum seal that normally exists between the bottom cover of the container and the contents of the container.

25. The container of claim 24 in which said means for creating a channel for communicating air comprises a flexible member disposed within the contents of the container.

26. The container of claim 25 in which said flexible member is a string.

27. The container of claim 26 in which said string further includes an engaging means at one end.

28. The container of claim 25 in which said flexible member is a hollow tube.

* * * * *